US006012399A

United States Patent [19]

Carter

[11] Patent Number: 6,012,399

[45] Date of Patent: Jan. 11, 2000

[54] PAPERBOARD PALLET

[75] Inventor: Leewood C. Carter, Ooltewah, Tenn.

[73] Assignee: Reusable Rolls, Inc., Ricerville, Tenn.

[21] Appl. No.: 09/275,474

[22] Filed: Mar. 24, 1999

[51] Int. Cl.[7] ..... B65D 19/00

[52] U.S. Cl. ..... 108/51.3; 108/57.22

[58] Field of Search ..... 108/51.3, 51.11, 108/56.1, 56.3, 57.22, 57.17, 57.19, 57.31, 57.33

[56] References Cited

U.S. PATENT DOCUMENTS

| | | | |
|---|---|---|---|
| 3,464,370 | 9/1969 | Martin | 108/51.3 |
| 3,683,622 | 8/1972 | Roberts et al. | 108/51.3 |
| 5,111,754 | 5/1992 | Adams, Jr. | 108/51.3 |
| 5,272,990 | 12/1993 | Carter | 108/51.3 |
| 5,636,577 | 6/1997 | Gow | 108/51.3 X |
| 5,816,172 | 10/1998 | Carter | 108/51.3 |

FOREIGN PATENT DOCUMENTS

| | | | |
|---|---|---|---|
| 494540 | 7/1992 | European Pat. Off. | 108/51.3 |

*Primary Examiner*—Jose V. Chen
*Attorney, Agent, or Firm*—Alan Ruderman

[57] ABSTRACT

A pallet constructed from paperboard has longitudinally extending runners formed by three spaced apart runner sections, each section being formed from paperboard cylindrical cores, the sections of each runner being connected together by a connecting member positioned on the upper surface of the runner sections and formed from elongated arcuate segments of a hollow cylindrical paperboard core. Deck members also formed from elongated arcuate segments of a hollow cylindrical paperboard core have arcuate slots extending transverse to the direction of elongation and are of a configuration conforming to the contour of the paperboard cores. Each deck member is positioned on the connecting members with the connecting members received within the slots and secured thereto. The spacing between the central member and the other two members permits the tines of a pallet jack to enter the space for lifting the pallet by engagement with the connecting members. The use of the connecting members not only provides a lighter pallet, but also raises the height of the deck so that there is sufficient height for receiving the pallet jack tines.

4 Claims, 1 Drawing Sheet

PAPERBOARD PALLET

BACKGROUND OF THE INVENTION

This invention relates to pallets constructed from paperboard, and more particularly to pallets constructed from cylindrical paperboard cores or tubes.

As discussed in Carter U.S. Pat. No. 5,067,418, assigned to the common assignee of the instant application, large amounts of thick walled paperboard or fiber cores or tubes are used by various industries. Paper, paperboard, carpet, cloth and plastics are wound about such cores and, after removal of these products from the cores, the cores must be disposed of.

Cores of this type can vary in length and generally have a four inch, five inch or six inch outside diameter with a wall thickness of at least 0.3 inch with a range up to 0.750 inch. The problems involved in disposing of heavy wall cores or tubes was pointed out and discussed in the aforesaid patent and an ecological solution to the disposal of spent cores was provided by a pallet constructed from such paperboard cores forming longitudinally extending runners and having a deck formed from a number of elongated arcuate segments of cylindrical paperboard cores in accordance with the disclosure and teachings thereof. In that patent, the arcuate deck segments are positioned within aligned dovetail notches in the runners. Other notches in the bottom of the runners received arcuate segments of cores to form lower brace members. Although pallets constructed in this manner proved to be commercially successful, the success was somewhat limited by the manufacturing process.

In an effort to reduce the manufacturing costs, the improved pallet disclosed in Carter U.S. Pat. No. 5,816,172 was developed in which runner receiving arcuate grooves are cut in the deck segments to aid in connecting the deck members to the runners rather than cutting dovetail notches in the runners. The runners thus did not have to be notched except to provide lift fork tine receiving recesses. Moreover, a base comprising slats was secured to the runners except at the tine receiving recesses. Although pallets constructed in accordance with U.S. Pat. No. 5,816,172 have had great success, they are relatively heavy and, in addition, use of pallet jacks rather than fork lift tines present a problem. A pallet jack, as opposed to a fork lift, has tines which are of a fixed width which have upper surfaces that are three inches high at the lowest position, i.e., before the jack is raised. Thus, depending upon the outside diameter of the runner tubes, they may be of insufficient height for the pallet jack tines to be received within the recesses. Moreover, this becomes even more of a problem when the base slats are removed in an effort to reduce the weight of the pallet because the bottoms of the runner tubes then sit directly on the floor thereby lowering the elevation of the tops of the runners.

SUMMARY OF THE INVENTION

Consequently, it is a primary object of the present invention to provide a relatively light weight rigid load supporting pallet constructed and assembled from paperboard cores or tubes of circular cross section configuration which are relatively inexpensive to manufacture.

It is another object of the present invention to provide a pallet having a plurality of runners constructed from sections of paperboard or fiber cores or tubes and having a deck formed from cross members constructed from segments of paperboard or fiber cores or tubes, the segments being formed with arcuate grooves for receiving and being interconnected to the runners by connecting members disposed on the upper surfaces of the runners.

It is a further object of the present invention to provide a pallet having a plurality of runners constructed from spaced apart sections of paperboard or fiber cores or tubes and having a deck formed from cross members constructed from segments of paperboard or fiber cores or tubes, the segments being formed with arcuate grooves for receiving and being interconnected to the runners by means of connecting or deck extender members disposed on the upper surfaces of the runners, the runner sections being spaced apart for receiving pallet jack tines and also avoiding any need to notch the runner tubes.

Accordingly, the present invention provides an improvement to the pallet disclosed in the aforesaid Carter patents and commonly owned Carter U.S. Pat. No. 5,272,990, and in addition, U.S. Pat. Nos. 3,256,839 and U.S. Pat. No. 3,654,877, by cutting arcuate grooves into deck segments and positioning the deck members transversely on connecting members or deck extenders positioned on and extending parallel to the axes of the runners, the connecting members or deck extenders being segments of the paperboard or fiber cores or tubes. The grooves in the deck members have an arcuate configuration conforming substantially to the abutting surface of the connecting members or extenders so that the upper surfaces of the runners have an apex lying in a common plane. The cores forming the runners thus need not be notched and, utilizing three runner sections spaced apart so that pallet jack tines may be received between a central section and the adjacent sections, no notching or recessing of the runners is required. Additionally, by forming the runners from sections rather than continuous tubes, the weight of the pallet is lightened substantially. Accordingly, not only is the manufacture of the pallet simplified and therefore less costly, but the pallets are also lighter in weight than that of the prior art constructions.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
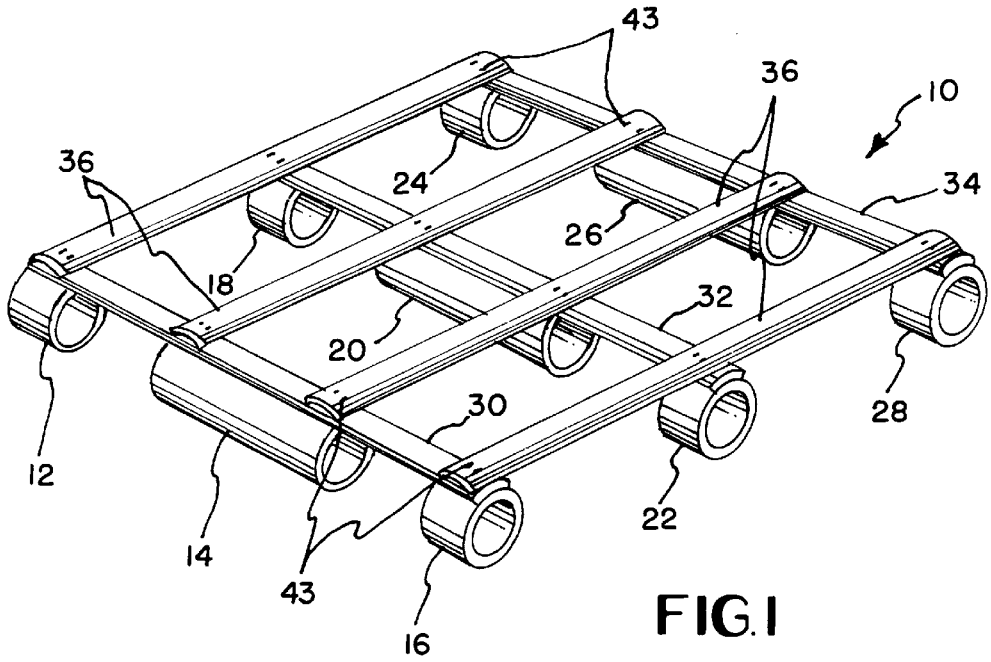
FIG. 1 is a perspective view of the preferred form of a pallet constructed in accordance with the principals of of the present invention.

Referring now to the drawings, a pallet generally designated at 10 is illustrated which incorporates structure constructed in accordance with the principles of the present invention. The pallet comprises a plurality of longitudinally extending runners constructed from hollow thick walled paperboard cores which are sectioned so that each runner comprises three members 12, 14, 16, and 18, 20, 22, and 24, 26, 28 respectively. Each set of members forming the runners, e.g. 12, 14, 16 are disposed substantially coaxially, so that the members of each set are aligned or substantially coaxial as if each set were a continuous runner. The respective central runner members 14, 20, 26 are longer than the end runners 12, 18, 24 and 16, 22, 28, and are spaced from the respective end runner members by a distance of approximately twelve inches. In the preferred embodiment the end runner members are approximately three inches long while the central runner members are approximately 18 inches long so that the spacing between the end members and the central members are approximately 12 inches for a 48 inch square pallet.

As described in the aforesaid Carter patents cores of the type used to form the runner members are generally available as hollow cylindrical members varying in length and generally have a 4 inch, 5 inch or 6 inch outside diameter. The most readily available cores are the 4 inch size and most pallets utilize runners of this size, although other sizes may be utilized. Cores of this type are typically used as a disposable mandrel about which paper, linger board, carpet or the like are wound in a roll and remain with the primary product until the roll is exhausted. These paperboard cores have a wall thickness varying from approximately 0.3 inch to approximately 0.75 inch and are known as thick walled cores. Since they do not readily break down in a pulper and are therefore not desirable for recycling at paperboard mills, they may be utilized for the manufacture of paperboard pallets in accordance with the present invention.

Figure 2:
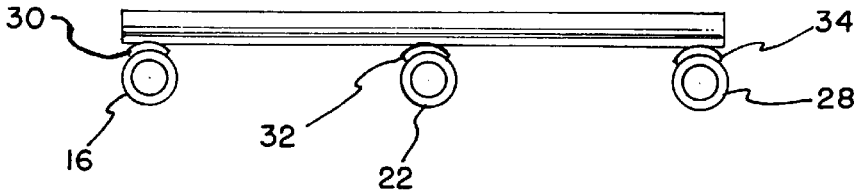
FIG. 2 is an end elevational view of the pallet illustrated in FIG. 1.
Figure 3:
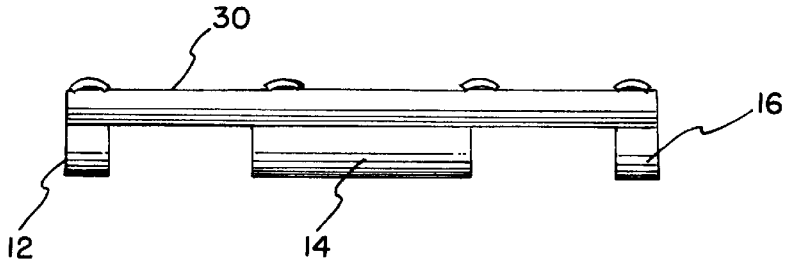
FIG. 3 is a front elevational view of the pallet.

In order to connect the runner sections 12, 14, 16 together, there is provided a first connecting or extender member 30 while the similar connecting or extender member 32 to connects the runner sections 18, 20, 22 together and a connecting or extender member 34 connects the runner sections 24, 26, 28 together. Each of the connecting extender members 30, 32, 34 comprises a segment of a paperboard core such as those used to form the runner members or, cores of larger diameter. Thus, they have an arcuate upper surface and an arcuate lower surface, as best illustrated in FIG. 2, which are sections of a circle having the outside diameter of the core and the inside diameter of the core as the respective arc. The lower surface of the connector extender members are disposed on the respective set of the runners and bonded thereto by glue and by staples (not illustrated) or the like. Even if the connecting extenders are constructed from the same diameter cores or tubes as the runner members, because the segment or arc is a small portion of the diameter of a core or tube, the lower surface will be positioned on the upper surface of the runner members correctly prior to bonding.

Figure 4:
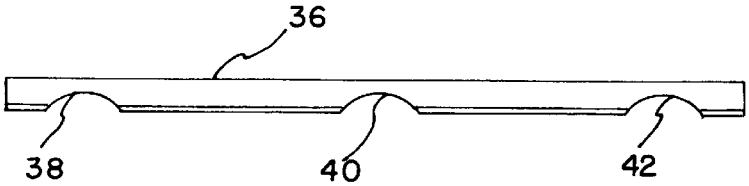
FIG. 4 is an elevational view of one of the deck forming members of the pallet.

As best illustrated in FIG. 4, the runners of the present invention do not include the notches as longitudinally spaced locations extending transversely as in the aforesaid U.S. Pat. No. 5,067,418. Instead, the cross members 36 are formed in the manner as in the aforesaid U.S. Pat. No. 5,816,172 from longitudinally extending segments of other cylindrical cores as described in the aforesaid patents to form the deck of the pallet and are designated as deck members. These members include spaced apart arcuate slots 38, 40, 42, the slots having a radius substantially equal to that of the paperboard cores which form the runner members and the other elements of the pallet such as the connecting extender members 30, 32, 34. The space in between the respective slots 38, 40, 42 is equal to the desired spacing between the runner sections 12, 18, 24 and 14, 20, 26 and 16, 22, 28. The slots 38, 40, 42 have a configuration conforming to the contour of the upper surface of the connecting extender members and may be bonded thereto by glue and staples 43 or the like. The apex of the upper surface of the deck members thus are substantially planar with each other and thus a flat deck surface is provided, i.e., although the deck members 30, 32, 34 have an arcuate configuration, the surface of the deck members most remote from the runners substantially lie in a common plane. Additionally, because of the arcuate contour of the slots 38, 40, 42, a substantially large contact surface is provided between the connecting extender members and the runners. This provides a relatively large contact surface for the application of glue, if desired. At any rate, staples 43, nails or other fastening members may be used to secure the deck members to the connecting extender members. Although any number of runner sets, connecting extender members and deck members may be utilized, it is expected that three such runner sets as illustrated will typically be used together with a corresponding number of connecting extender members and with a sufficient number of deck members to support the varying loads to be carried by the pallet.

The spacing between the runner members, 12, 18, 24 and the adjacent runner members 14, 20, 26 and also the spacing between these latter runner members and the runner members 16, 22, 28 is such that the tines of a pallet jack may be inserted. Moreover, this provides for four-way entry by the tines of a fork lift or the like. The tines of either the pallet jack or the fork lift when entering between the separated runner members of the runner sets, when lifted, will engage the extender members 30, 32, 34.

The connecting extender members and the deck members may, if desired, be of identical size so as to minimize the inventory of elements prior to assembling. As aforesaid, they are formed from core members which are cut longitudinally so as to form a plurality of such members. The runners are merely core members which are cut transversely to the axes thereof to the desired lengths. Because a substantial amount of the runners are eliminated by this construction, and the connecting extender members are substantially lighter in weight than the removed core member portions, the pallets are substantially lighter in weight than that of the prior art pallets. Moreover, since the connecting extender members 30, 32, 34 are positioned on the upper surfaces of the runner members, there is a greater distance provided for the pallet jacks to enter between the floor and the lower surface of the connecting extender members than there was available in the prior art pallets illustrated in the aforesaid U.S. Pat. No. 5,816,172 which provided slots in the runners for receipt of the tines of a fork lift or pallet jack. As aforesaid, in the prior art, the amount of room was insufficient for effective use of the pallet jacks.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A pallet having a load supporting deck and a plurality of parallel spaced apart runners, each runner comprising an aligned set of at least three spaced apart runner members formed from hollow cylindrical paperboard cores, said deck including a plurality of spaced apart deck members extending transversely to the runners, each deck member comprising an elongated arcuate segment of a hollow cylindrical paperboard core, a connecting member disposed on a surface of each of the runner members of a set of said members and substantially parallel to the axes of the members of the set, said surface defining an upper surface of a respective runner, each connecting member comprising an elongated arcuate segment of a hollow cylindrical paperboard core having an exterior and an interior cylindrical configuration, a plurality of slots formed in said deck members extending transversely to the direction of elongation of the deck members, each slot having an arcuate configuration conforming to the cylindrical configuration of the exterior of the connecting members such that a surface portion of each connecting member may be received within one of the slots, and fastening means for securing each deck member to all the runners with each connecting member being disposed within one of the slots of each deck member.

2. A pallet as recited in claim 1, wherein said slots are spaced apart by an equal amount.

3. A pallet as recited in claim 2, wherein there are three spaced apart runner members forming each runner, the spacing between a central one of said runner members of each runner and the remaining runner members of each runner being sufficient to receive lifting tines of a pallet jack.

4. A pallet as recited in claim 3, wherein the central runner member of each runner is substantially longer than the other runner members of each runner.

* * * * *